US005656100A

United States Patent [19]

Yamamoto et al.

[11] Patent Number: 5,656,100

[45] Date of Patent: Aug. 12, 1997

[54] ALLOY INGOT FOR PERMANENT MAGNET, ANISOTROPIC POWDERS FOR PERMANENT MAGNET, METHOD FOR PRODUCING SAME AND PERMANENT MAGNET

[75] Inventors: Kazuhiko Yamamoto, Kobe; Yuichi Miyake, Kasai; Chikara Okada, Kobe, all of Japan

[73] Assignee: Santoku Metal Industry Co., Ltd., Hyogo-ken, Japan

[21] Appl. No.: 636,905

[22] Filed: Apr. 18, 1996

Related U.S. Application Data

[60] Continuation of Ser. No. 410,884, Mar. 27, 1995, abandoned, which is a division of Ser. No. 307,363, Sep. 16, 1994, abandoned, which is a division of Ser. No. 17,043, Feb. 12, 1993, Pat. No. 5,383,978.

[30] Foreign Application Priority Data

| | | | |
|---|---|---|---|
| Feb. 15, 1992 | [JP] | Japan | 4-028656 |
| May 21, 1992 | [JP] | Japan | 4-128936 |
| Sep. 7, 1992 | [JP] | Japan | 4-238299 |

[51] Int. Cl.[6] ..... H01F 1/057

[52] U.S. Cl. ..... 148/302; 420/83; 420/121; 148/101; 148/104

[58] Field of Search ..... 148/302, 101, 148/102, 104, 105; 420/83, 121

[56] References Cited

U.S. PATENT DOCUMENTS

| | | | |
|---|---|---|---|
| 4,496,395 | 1/1985 | Croat | 148/301 |
| 4,536,233 | 8/1985 | Okonogi et al. | 148/101 |
| 4,921,551 | 5/1990 | Vernia et al. | 148/101 |
| 4,981,532 | 1/1991 | Takeshita et al. | 148/302 |
| 5,067,551 | 11/1991 | Murakami et al. | 148/101 |
| 5,127,970 | 7/1992 | Kim | 148/105 |
| 5,172,751 | 12/1992 | Croat | 148/101 |
| 5,221,770 | 6/1993 | Ishiguro et al. | 148/302 |
| 5,314,548 | 5/1994 | Panchanathan et al. | 148/101 |
| 5,431,747 | 7/1995 | Takebuchi et al. | 148/302 |

FOREIGN PATENT DOCUMENTS

| | | | |
|---|---|---|---|
| 0101552 | 2/1984 | European Pat. Off. . | |
| 58-186906 | 11/1983 | Japan | 148/102 |
| 63-213102 | 9/1987 | Japan | 148/101 |
| 2-156510 | 6/1990 | Japan | 148/302 |
| 4-6806 | 1/1992 | Japan | 148/545 |
| 4-174501 | 6/1992 | Japan | 148/301 |

*Primary Examiner*—John Sheehan
*Attorney, Agent, or Firm*—Darby & Darby

[57] ABSTRACT

An alloy ingot for permanent magnet consists essentially of rare earth metal and iron and optionally boron. The two-component alloy ingot contains 90 vol % or more of crystals having a crystal grain size along a short axis of 0.1 to 100 μm and that along a long axis of 0.1 to 100 μm. The three-component alloy ingot contains 90 vol % or more of crystals having a crystal grain size along a short axis of 0.1 to 50 μm and that along a long axis of 0.1 to 100 μm. The alloy ingot is produced by solidifying the molten alloy uniformly at a cooling rate of 10° to 1000° C./sec. at a sub-cooling degree of 10° to 500° C. A permanent magnet and anisotropic powders are produced from the alloy ingot.

5 Claims, 1 Drawing Sheet

ALLOY INGOT FOR PERMANENT MAGNET, ANISOTROPIC POWDERS FOR PERMANENT MAGNET, METHOD FOR PRODUCING SAME AND PERMANENT MAGNET

CROSS-REFERENCE TO RELATED APPLICATIONS

This application is a continuation application of U.S. Ser. No. 08/410,884, filed Mar. 27, 1995, now abandoned, which is a divisional application of U.S. Ser. No. 08/307,363, filed Sep. 16, 1994, now abandoned, which is a divisional application of U.S. Ser. No. 08/017,043, filed Feb. 12, 1993, now U.S. Pat. No. 5,383,978, issued Jan. 24, 1995.

BACKGROUND OF THE INVENTION

This invention relates to an alloy ingot for permanent magnet of rare earth metal-iron or rare earth metal-iron-boron having a crystalline structure excellent in magnetic properties, anisotropic permanent magnet powders of rare earth metal-iron-boron, a method for producing the ingot or powders, and a rare earth metal-iron permanent magnet.

Permanent magnet alloy ingots are generally produced by a metal mold casting method consisting in casting molten alloy in a metal mold. If the molten alloy is to be solidified by the metal mold casting method, it is the heat conduction through the casting mold that determines the rate of heat removal during the initial stage of the heat removal process for the molten alloy. However, as solidification proceeds, the heat conduction between the casting mold and the solidified phase or in the solidifying phase determines the rate of heat conduction. Even though the cooling capacity of the metal mold is improved, the inner portions of the ingot and those portions of the ingot in the vicinity of the casting mold are subjected to different cooling conditions. Such phenomenon is the more pronounced the thicker the ingot thickness. The result is that in the case of a larger difference between the cooling conditions in the inner portions of the ingot and those in the vicinity of the ingot surface, an α-Fe phase having a grain size of 10 to 100 μm is left in the cast structure towards a higher residual magnetic flux density region in the magnet composition, while the rare earth metal rich phase surrounding the main phase is also increased in size. Since the α-Fe phase and the rare earth metal rich coarse-grained phase can be homogenized difficultly by heat treatment usually carried out at 900° to 1200° C. for several to tens of hours, the homogenization process in the magnet production process is prolonged with crystal grains being increased further in size. Besides, since the ensuing nitriding process is prolonged, nitrogen contents in the individual grains become non-uniform, thus affecting subsequent powder orientation and magnetic characteristics.

Although crystals having a short axis length of 0.1 to 100 μm and a long axis length of 0.1 to 100 μm are known to exist in the structure of the ingot produced by the above-mentioned metal mold casting method, the content of these crystals is minor and unable to influence the magnetic properties favorably. There has also been proposed a method for producing a rare earth metal magnet alloy comprising charging a rare earth metal element and cobalt and, if needed, iron, copper and zirconium into a crucible, melting the charged mass and allowing the molten mass to be solidified to have a thickness of 0.01 to 5 mm by, e.g. a strip casting system combined with a twin roll, a single roll, a twin belt or the like.

Although an ingot produced by this method has a composition more uniform than that obtained with the metal mold casting method, since the components of the feed material consist in the combination of rare earth metal, cobalt and occasionally iron, copper and zirconium, and the produced alloy is amorphous, the magnetic properties cannot be improved sufficiently by the above-mentioned strip casting method. In other words, production of the crystal permanent magnet alloy by the strip casting method has not been known to date.

SUMMARY OF THE INVENTION

It is an object of the present invention to provide an alloy ingot for permanent magnet having a crystalline structure which influences most favorably the properties of the rare earth metal-iron or rare earth metal-iron-boron permanent magnet alloy, and a method for producing the permanent magnet alloy ingot.

It is another object of the present invention to provide an alloy ingot for permanent magnet of rare earth metal-iron having a crystalline structure affording excellent magnetic properties, a method for producing the alloy ingot, and a permanent magnet.

It is a further object of the present invention to provide powders for permanent magnet exhibiting high anisotropy and having a crystalline structure influencing most favorably the properties of the rare earth metal-iron-boron permanent magnet and a method for producing the same.

The above and other objects of the invention will become apparent from the following description.

According to the present invention, there is provided an alloy ingot for permanent magnet consisting essentially of rare earth metal and iron, the alloy ingot containing 90 vol % or more of crystals having a crystal grain size along a short axis of 0.1 to 100 μm and that along a long axis of 0.1 to 100 μm.

According to the present invention, there is also provided a method of producing an alloy ingot for permanent magnet comprising melting a rare earth metal-iron alloy to obtain a molten alloy and solidifying the molten alloy uniformly at a cooling rate of 10° to 1000° C./sec. at a sub-cooling degree of 10° to 500° C.

According to the present invention, there is also provided a rare earth metal-iron permanent magnet obtained by magnetizing the aforementioned rare earth metal-iron permanent magnet alloy ingot wherein the permanent magnet contains atoms selected from the group consisting of carbon atoms, oxygen atoms, nitrogen atoms and mixtures thereof.

According to the present invention, there is also provided an alloy ingot for permanent magnet consisting essentially of rare earth metal, iron and boron, the alloy ingot containing 90 vol % or more of crystals having a crystal grain size along a short axis of 0.1 to 50 μm and that along a long axis of 0.1 to 100 μm.

According to the present invention, there is also provided a method of producing an alloy ingot for permanent magnet comprising melting a rare earth metal-iron-boron alloy to obtain a molten alloy and solidifying the molten alloy uniformly at a cooling rate of 10° to 1000° C./sec. at a sub-cooling degree of 10° to 500° C.

According to the present invention, there are also provided anisotropic powders for permanent magnet obtained by hydrogenating the aforementioned rare earth metal-iron-boron alloy ingot.

According to the present invention, there is provided a method of producing anisotropic powders for pemanent magnet comprising subjecting the aforementioned rare earth metal-iron-boron alloy ingot to hydrogenating treatment to cause hydrogen atoms to be intruded into and released from the aforementioned rare earth metal-iron-boron alloy ingot in a hydrogen atmosphere and to allow the alloy ingot to be recrystallized and subsequently pulverizing the recrystallized alloy ingot.

PREFERRED EMBODIMENTS OF THE INVENTION

Figure 1:
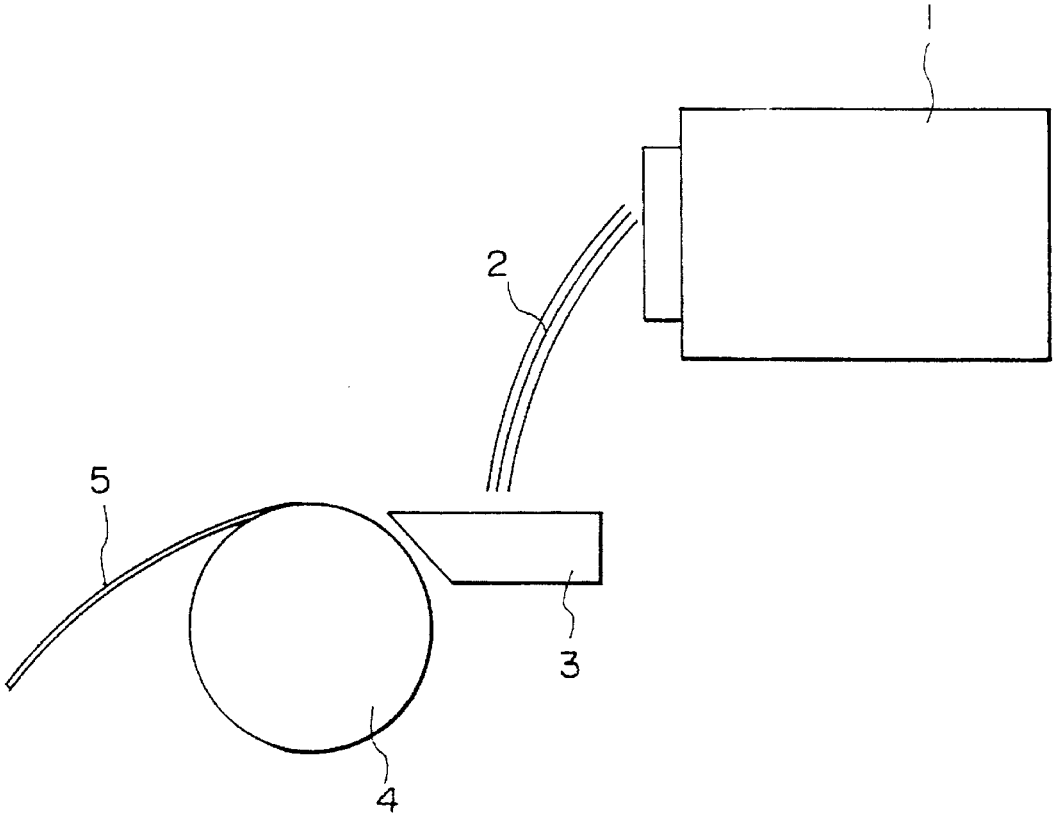
FIG. 1 is a schematic view showing the production of an alloy ingot for permanent magnet by the strip casting method employed in the Examples.

The present invention will be explained in more detail hereinbelow.

The rare earth metal-iron alloy ingot for permanent magnet, referred to hereinafter as alloy ingot A contains crystals, each having a crystal grain size along the short axis of 0.1 to 100 μm and that along the long axis of 0.1 to 100 μm in an amount not less than 90 vol % and preferably not less than 95 vol %. It is preferred above all that the alloy ingot be free of α-Fe and/or γ-Fe usually contained in the main phase crystal grains as peritectic nuclei. If α-Fe or γ-Fe be contained in the main phase crystal grains, it is preferred that these α-Fe and/or γ-grains be less than 20 μm in grain size and be dispersed in finely divided form. If the content of the crystals having the above-mentioned grain size is less than 90 vol %, excellent magnetic properties cannot be afforded to the produced alloy ingot. If the lengths along the short axis or along the long axis are outside the above range, or if the grain size of the α-Fe and/or γ-Fe exceeds 20 μm, or the crystals are not dispersed finely, the time duration of the homogenizing heat treatment in the production process for the permanent magnet may undesirably be prolonged. The thickness of the alloy ingot A may desirably be in the range of from 0.05 to 20 mm. If the thickness exceeds 20 mm, the production method for producing the desired crystal structure later described may become undesirably difficult.

There is no limitation to the feed materials used for producing the alloy ingot A if they are rare earth metal-iron components. Samarium, neodymium or praseodymium may preferably be enumerated as the rare earth metal. Impurities unavoidably contained in the feed materials during the usual production process may also be contained. The rare earth metal may be used alone or in combination. The proportion of the rare earth metal and iron may be the same as that used in the usual permanent magnet alloy ingot and may preferably be 23 to 28:77 to 72 by weight.

The rare earth metal-iron-boron alloy ingot for permanent magnet, referred to hereinafter as alloy ingot B, contains crystals, each having a crystal grain size along the short axis of 0.1 to 50 μm and that along the long axis of 0.1 to 100 μm in an amount not less than 90 vol % and preferably not less than 98 vol %. It is preferred above all that the alloy ingot be free of α-Fe and/or γ-Fe usually contained in the main phase crystal grains as peritectic nuclei. If α-Fe and/or γ-Fe be contained in the main phase crystal grains, it is preferred that these α-Fe and/or γ-grains be less than 10 μm in grain size and be dispersed in finely divided form. If the content of he crystals having the above-mentioned grain size is less than 90 vol %, excellent magnetic properties cannot be afforded to the produced alloy ingot. If the lengths along the short axis or along the long axis are outside the above range, or if the grain size of the α-Fe and/or γ-Fe exceeds 10 μm, or the crystals are not dispersed in finely divided form, the time duration of the homogenizing heat treatment in the production process for the permanent magnet may undesirably be prolonged. The thickness of the alloy ingot B may preferably be in the range of from 0.05 to 15 mm. If the thickness exceeds 15 mm, the production method for producing the desired crystal structure later described may become undesirably difficult.

There is no limitation to the feed materials used for producing the alloy ingot B, if they are rare earth metal-iron-boron components. Neodymium, praseodymium or dysprosium may preferably be enumerated as the rare earth metal. Impurities unavoidably contained in the feed materials during the usual production process may also be contained. The rare earth metal may be used alone or in combination. The proportions of the rare earth metal, boron and iron may be the same as those in the customary permanent magnet alloy ingot, and may preferably be 25 to 40:0.5 to 2.0: balance in terms of the weight ratio.

In the method for producing the above-mentioned alloy ingot A of the present invention, the rare earth metal-iron alloy in the molten state is allowed to be uniformly solidified under the cooling conditions of the cooling rate of 10° to 1000° C./sec., preferably 100° to 1000° C./sec., and the sub-cooling degree of 10° to 500° C. and preferably 200° to 500° C. In the method for producing the above-mentioned alloy ingot B, the rare earth metal-iron-boron alloy in the molten state is allowed to be uniformly solidified under the cooling conditions of the cooling rate of 10° to 1000° C./sec., preferably 100° to 500° C./sec. and the sub-cooling degree of 10° to 500° C. and preferably 200° to 500° C.

The sub-cooling degree herein means the degree of (melting point of the alloy)—(actual temperature of the alloy in the molten state), which value is correlated with the cooling rate. If the cooling rate and the sub-cooling degree are outside the above-mentioned ranges, the alloy ingot A or B having the desired crystal structure cannot be produced.

If the method for producing the alloy ingots A and B according to the present invention is explained more concretely, the alloy ingot A or B having the desired crystal structure may be produced by a strip casting method consisting in melting the rare earth metal-iron alloy or a rare earth metal-iron-boron alloy in an inert gas atmosphere by, for example, vacuum melting or high frequency melting, preferably in a crucible, and allowing the molten mass to be solidified in contact with, for example, a single roll, a twin roll or a disk, preferably continuously under the above-mentioned conditions. That is, if the molten feed alloy is solidified by the strip casting method, it is most preferred to select the casting temperature and the molten mass feed rate so that the thickness of the alloy ingot is preferably in a range of from 0.05 to 20 mm for the alloy ingot A and in a range of from 0.05 to 15 mm for the alloy ingot B and to process the molten mass under the aforementioned conditions. The produced alloy ingots are preferably homogenized at a temperature preferably in a range of 900° to 1200° C. for 5 to 50 hours, if so desired.

The anisotropic powders for permanent magnet consisting essentially of rare earth meatal, iron and boron according to the present invention, referred to hereinafter as anisotropic powders C, are produced by hydrogenating the alloy ingot B, and are preferably of particle size of 200 to 400 μm.

With the method for producing the anisotropic powders C according to the present invention, the alloy ingot B is processed under a hydrogen atmosphere for causing hydrogen atoms to be intruded into and released from the alloy ingot B by way of hydrogenation treatment. The main phase crystals are recrystallized by this treatment and subsequently pulverized. More specifically, for producing the anisotropic powders C, the alloy ingot B may be crushed to a size of, e.g. 1 to 10 mm and processed by homogenizing treatment, preferably for 5 to 50 hours at 900° to 1200° C., after which it is maintained in a hydrogen atmosphere of 1 atm. at 800° to 850° C. for 2 to 5 hours, and rapidly cooled or quenched after rapid evacuation to $10^{-2}$ to $10^{-3}$ Torr to permit intrusion and release of hydrogen atoms and subsequent recrystallization.

The alloy ingots A and B of the present invention may be formed into permanent magnets, such as resin magnets or bond magnets by the conventional process steps of pulverization, mixing, comminution, compression in the magnetic field and sintering. Similarly, the anisotropic powders C may be formed into the permanent magnets such as resin magnets or the bond magnets by the usual magnet production process.

The permanent magnet of the present invention is produced by magnetizing the alloy ingot A and contains carbon, oxygen or nitrogen atoms or mixtures thereof.

The content of the carbon, oxygen or nitrogen atoms or their mixtures in the permanent magnet of the present invention may preferably be 1 to 5 parts by weight and more preferably 2 to 4 parts by weight to 100 parts by weight of the alloy ingot A.

The magnetization treatment for preparing the permanent magnet of the present invention may consist in crushing the alloy ingot A to a particle size, preferably of 0.5 to 50 mm, followed by inclusion of desired atoms selected from the group consisting of carbon atoms, oxygen atoms, nitrogen atoms and mixtures thereof into the resulting crushed product. More specifically, the desired atoms may be included in the crushed product by heat treatment for several to tens of hours in a 1 atm. gas atmosphere at 300° to 600° C. containing the aforementioned atoms. The crushed mass containing the desired atoms may be pulverized to have a particle size of 0.5 to 30 μm and molded into a permanent magnet by any known method such as compression under a magnetic field or injection molding.

The alloy ingots A and B are of the rare earth metal-iron or rare earth metal-iron-boron composition containing a specified amount of crystals having a specified crystal grain size, so that they exhibit superior pulverizability and sinterability and hence may be used as a feed material for a permanent magnet having excellent properties.

With the method of the present invention, the above-mentioned alloy ingot A or B having the composition and texture exhibiting superior homogeneity may be easily produced with the particular cooling rate and with the particular sub-cooling degree.

The anisotropic powders C of the present invention are produced by hydrogenizing the alloy ingot B and exhibit high anisotropy and excellent properties as magnet so that they may be employed as the starting material for producing permanent magnets, such as resin magnets or bond magnets.

The permanent magnet of the present invention produced from the alloy ingot A and containing carbon atoms, oxygen atoms, nitrogen atoms or mixtures thereof, exhibit excellent magnetic properties.

EXAMPLES OF THE INVENTION

The present invention will be explained with reference to Examples and Comparative Examples. These Examples, however, are given only for illustration and are not intended for limiting the invention.

Example 1

An alloy containing 24.5 wt % of samarium and 74.5 wt % of iron was melted in an argon gas atmosphere by a high frequency melting method, using an alumina crucible. The resulting molten mass was processed into a rare earth metal-iron permanent magnet alloy ingot in accordance with the following process, using an equipment shown in FIG. 1.

In FIG. 1, there is schematically shown a system for producing a permanent magnet alloy ingot by a strip casting method using a single roll, wherein 1 is a crucible filled with the above-mentioned molten mass produced by the high frequency melting method. The molten mass 2 maintained at 1500° C. was continuously cast onto a tundish 3 and allowed to descend onto a roll 4 rotated at a rate of approximately 1 m/sec. The molten mass was allowed to be quenched and solidified under design cooling conditions of the cooling rate of 1000° C./sec and the sub-cooling degree of 200° C. The molten mass 2 was allowed to descend continuously in the rotating direction of the roll 4 for producing an alloy ingot 5 having a thickness of 0.5 mm.

The produced alloy ingot 5 was homogenized at 1100° C. for 20 hours. The amounts of α-Fe remaining in the alloy ingot 5 were measured after lapse of 5, 10, 20, 30 and 40 hours. The results are shown in Table 1. The crystal grain size of the alloy ingot was also measured at a time point when α-Fe disappeared. The results are shown in Table 2. The alloy ingot, 5 was subsequently crushed to have a size of 0.5 to 5 mm and the produced powders were nitrided at 500° C. for three hours in a 1 atm. nitrogen gas atmosphere. The produced nitrided powders were comminuted to have a mean particle size of the order of 2 μm using a planetary mill. The produced powders were compressed under conditions of 150 MPa and 2400 $KAm^{-1}$ in a magnetic field to produce compressed powders. The magnetic properties of the produced compressed powders were measured using a dc magnetic measurement unit. The results are shown in Table 3.

Example 2

The rare earth metal-iron permanent magnet alloy ingot was produced in the same way as in Example 1 except using an alloy consisting of 25.00 wt % of samarium and 75 wt % of iron. After homogenizing treatment, the residual quantity of α-Fe was measured, and compressed powders were prepared. Tables 1, 2 and 3 show the residual quantities of α-Fe, crystal grain size and magnetic properties, respectively.

Comparative Examples 1 and 2

Alloys having the same compositions as those of the alloys produced in Examples 1 and 2 were melted by the high frequency melting method and processed into rare earth metal-iron permanent magnet alloy ingots of 30 mm thickness under conditions of the cooling rate of 10° C./sec. and sub-cooling degree of 20° C. by the metal mold casting method, respectively. Each of the α-Fe content remaining after the homogenizing treatment of each produced alloy ingot was measured in the same way as in Example 1, and compressed powders were also produced in the same way as in Example 1. Since the α-Fe was left after homogenizing treatment continuing for 40 hours, the crystal grain size which remained after 40 hours after the start of the homogenizing treatment is entered in Table 1.

TABLE 1

| Ex./Comp. Ex. | Residual quantities of α-Fe (%) 5 hrs. | 10 hrs. | 20 hrs. | 30 hrs. | 40 hrs. |
|---|---|---|---|---|---|
| Ex. 1 | 2 | 0.5 | 0 | 0 | 0 |
| Ex. 2 | 2 | 0 | 0 | 0 | 0 |
| Comp. Ex. 1 | 10 | 9 | 8 | 5 | 3 |
| Comp. Ex. 2 | 8 | 7 | 4 | 2 | 0 |

TABLE 2

| Ex./Comp. Ex. | Mean crystal grain size (μm) | Standard deviation (μm) |
|---|---|---|
| Ex. 1 | 46 | 22 |
| Ex. 2 | 58 | 28 |
| Comp. Ex. 1 | 120 | 50 |
| Comp. Ex. 2 | 130 | 35 |

TABLE 3

| Ex./Comp. Ex. | 4πJs (KG) | Br (KG) | iHc (KOe) |
|---|---|---|---|
| Ex. 1 | 12.0 | 9.5 | 10.0 |
| Ex. 2 | 11.5 | 9.0 | 11.0 |
| Comp. Ex. 1 | 10.5 | 7.5 | 8.5 |
| Comp. Ex. 2 | 8.5 | 6.0 | 9.0 |

Example 3

An alloy containing 14 atom % of neodymium, 6 atom % of boron and 80 atom % of iron was melted by a high frequency melting method in an argon gas atmosphere using an alumina crucible. The temperature of the molten mass was raised to aid maintained at 1350° C. Using he equipment shown in FIG. 1, a rare earth metal-iron-boron permanent magnet alloy ingot, 0.2 to 0.4 mm thick, was prepared in the same way as in Example 1 except that the temperature of the molten mass 2 was set to 1350° C. and the cooling rate was set to 1000° C./sec. Table 4 shows the results of chemical analyses of the produced alloy ingot.

The produced rare earth metal-iron-boron permanent magnet alloy ingot was pulverized to a 250 to 24 mesh size and further pulverized to approximately 3 μm in alcohol. The fine powders were compressed in a magnetic field at 150 MPa and 2400 $KA^{-1}$ and sintered for two hours at 1040° C. to produce a permanent magnet 10×10×15 mm in size. The magnetic properties of the produced permanent magnet are shown in Table 5.

Example 4

A rare earth metal-iron-boron permanent magnet alloy ingot was prepared in the same way as in Example 3 except using an alloy containing 11.6 atom % of neodymium, 3.4 atom % of praseodymium, 6 atom % of boron and 79 atom % of iron. The produced alloy ingot was analyzed in the same way as in Example 3 and a permanent magnet was further prepared. Tables 4 and 5 show the results of analyses of the alloy ingot and the magnetic properties, respectively.

Comparative Example 3

The molten alloy prepared in Example 3 was melted by the high frequency melting method and processed into a rare earth metal-iron-boron permanent magnet alloy ingot, 25 mm in thickness, by the metal mold casting method. The produced alloy ingot was analyzed in the same way as in Example 3 and a permanent magnet was also prepared. Tables 4 and 5 show the results of analyses of the alloy ingot and the magnetic properties, respectively.

TABLE 4

| | Main phase crystal grain size (μm) (Mean value) | Standard deviation | Crystal grain size of α-Fe | Phase rich in rare earth metal (R) |
|---|---|---|---|---|
| Ex. 3 | Short axis 3 to 10 (7) | 2 | Not noticed | Uniformly dispersed around main phase |
| | Long axis 10 to 80 (70) | 20 | | |
| Ex. 4 | Short axis 5 to 10 (7) | 4 | Not noticed | Uniformly dispersed |
| | Long axis 50 to 100 (80) | 30 | | |
| Comp. Ex. 3 | Short axis 50 to 250 (170) | 50 | Grains of tens of micrometers crystallized | Mainly α-Fe and (R) phase of tens to hundreds of micrometers dispersed |
| | Long axis 50 to 400 (190) | 60 | | |

TABLE 5

| | Ex. 3 | Ex. 4 | Comp. Ex. 3 |
|---|---|---|---|
| Br (KG) | 12.9 | 12.5 | 11.8 |
| iHc (KOe) | 15.0 | 15.5 | 14.9 |
| (BH) max (MGOe) | 41.0 | 39.0 | 35.7 |

Example 5

A rare earth metal-iron-boron permanent magnet alloy ingot was prepared in the same way as in Example 3 except setting the cooling rate to 500° C./sec. The results of analyses of the produced alloy ingot are shown in Table 6.

TABLE 6

| | Main phase crystal grain size (μm) (Mean value) | Standard deviation | Crystal grain size of α-Fe | Phase rich in rare earth metal (R) |
|---|---|---|---|---|
| Ex. 5 | Short axis 3 to 10 (7) | 2 | Not noticed | Uniformly dispersed around main phase |
| | Long axis 10 to 80 (60) | 20 | | |

The produced rare earth metal-iron-boron permanent magnet alloy ingot was crushed to 5 mm in particle size and subjected to homogenizing treatment at 1000° C. for 40 hours. The superficial ratio or surface ratio of α-Fe after lapse of 5, 10, 15, 20 and 40 hours since the start of the processing were measured by image analyses of an image observed under a scanning electron microscope. The results are shown in Table 7. The mean crystal grain size along the long axis, as measured by a scanning electron microscope, after the homogenizing treatment for 10 hours, was 60 μm.

The alloy ingot subjected to homogenizing treatment was charged into a vacuum hating oven and held at 820° C. for three hours in a 1 atm. hydrogen atmosphere. The oven was subsequently evacuated to $10^{-2}$ Torr within two minutes. The alloy ingot was transferred into a cooling vessel and quenched. The quenched alloy ingot was taken out of the vessel and pulverized to have a mean particle size of 300 μm.

The resulting powders were placed under a pressure of 0.5 t/cm$^2$ in a magnetic field of 150 kOe and uniaxially compressed to give compressed powders. The crystal orientation of the compressed powders was measured by X-ray diffraction and the orientation F was calculated in accordance with the formula F=Amount of X-rays diffracted at (006)/total amount of X rays diffracted at (311) to (006)

The orientation F (006) was found to be 60. The magnetic properties were also measured. The results are shown in Table 8.

Comparative Example 4

The melted alloy prepared in Example 5 was melted by the high frequency melting method and a rare earth metal-iron-boron permanent magnet alloy ingot, 25 mm thick, was produced by the metal mold casting method. The resulting alloy ingot was subjected to homogenizing treatment in the same way as in Example 5 and the superficial ratio of α-Fe was measured. The results are shown in Table 7. The crystal grain size after the homogenizing treatment for 10 hours was measured in the same way as in Example 5. The mean crystal grain size along the long axis was 220 μm.

The alloy ingot was subjected to hydrogenation and pulverized in the same way as in Example 5. The (006) crystal orientation of the produced crystals was 30. The magnetic properties were also measured in the same way as in Example 5. The results are shown in Table 8.

TABLE 7

| | Surface ratio of α-Fe (%) | | | | | |
|---|---|---|---|---|---|---|
| Processing time (hrs.) | 0 | 5 | 10 | 15 | 20 | 40 |
| Ex. 5 | 5 | 4 | 0 | 0 | 0 | 0 |
| Comp. Ex. 4 | 15 | 15 | 14 | 13 | 10 | 7 |

TABLE 8

| Magnetic Properties | 4πJs (kG) | Br (kG) | iHc (kOe) |
|---|---|---|---|
| Ex. 5 | 11.0 | 9.0 | 10 |
| Comp. Ex. 4 | 9.5 | 6.5 | 2 |

Although the present invention has been described with reference to the preferred examples, it should be understood that various modifications and variations can be easily made by those skilled in the art without departing from the spirit of the invention. Accordingly, the foregoing disclosure should be interpreted as illustrative only and is not to be interpreted in a limiting sense. The prsent invention is limited only by the scope of the following claims.

What is claimed is:

1. Rare earth metal-iron-boron anisotropic powders for use in a permanent magnet obtained by hydrogenating and dehydrogenating an alloy ingot consisting essentially of rare earth metal, iron and boron, said alloy ingot containing 90 vol % or more of crystals having a crystal grain size along a short axis of 0.1 to 50 μm and along a long axis of 0.1 to 100 μm, said crystals being free of peritectic nuclei selected from the group consisting of α-Fe, γ-Fe, and mixtures thereof.

2. Rare earth metal-iron-boron anisotropic powders for use in a permanent magnet obtained by hydrogenating and dehydrogenating an alloy ingot consisting essentially of rare earth metal, iron and boron, said alloy ingot containing 90 vol % or more of crystals having a crystal grain size along a short axis of 0.1 to 50 μm and along a long axis of 0.1 to 100 μm, said crystals being free of peritectic nuclei selected from the group consisting of α-Fe, γ-Fe, and mixtures thereof having grain size greater than 10 μm.

3. The rare earth metal-iron-boron anisotropic powders as claimed in claim 1 or 2 wherein said alloy ingot is produced by a strip casting method comprising melting a rare earth metal alloy to obtain a molten alloy and solidifying the molten alloy uniformly at a cooling rate of 10° to 1000° C./sec. at a sub-cooling degree of 10° to 500° C.

4. The rare earth metal-iron-boron anisotropic powders as claimed in claim 1 wherein said rare earth metal is selected from the group consisting of neodymium, praseodymium, dysprosium, and mixtures thereof.

5. The rare earth metal-iron-boron anisotropic powders as claimed in claim 2 wherein said rare earth metal is selected from the group consisting of neodymium, praseodymium, dysprosium, and mixtures thereof.

* * * * *